United States Patent [19]

Deutsch

[11] 4,251,687

[45] Feb. 17, 1981

[54] STEREOPHONIC SOUND REPRODUCING SYSTEM

[76] Inventor: Hans Deutsch, Bergerbräuhofstrasse 34, A-5020 Salzburg, Austria

[21] Appl. No.: 3,314

[22] Filed: Jan. 12, 1979

[30] Foreign Application Priority Data

Jan. 12, 1978 [DE] Fed. Rep. of Germany ..... 2801227

[51] Int. Cl.[3] ..... H04S 1/00; H04R 1/02

[52] U.S. Cl. ..... 179/1 GA; 181/156; 181/152; 181/154

[58] Field of Search ..... 179/1 GA, 1 E; 181/156, 181/144, 147, 152, 154, 159, 182, 184, 192

[56] References Cited

U.S. PATENT DOCUMENTS

| | | | |
|---|---|---|---|
| 2,224,919 | 12/1940 | Olson | 181/152 |
| 2,751,997 | 6/1956 | Gately | 181/152 |
| 2,835,335 | 5/1958 | Glassey | 181/152 |
| 3,047,090 | 7/1962 | Pruden | 181/156 |
| 3,627,948 | 12/1971 | Nichols | 181/154 |
| 4,006,311 | 2/1977 | Carlsson | 179/1 GA |
| 4,073,365 | 2/1978 | Johnson | 181/147 |

FOREIGN PATENT DOCUMENTS

| | | | |
|---|---|---|---|
| 642165 | 6/1962 | Canada | 181/156 |
| 765183 | 1/1957 | United Kingdom | 181/156 |

OTHER PUBLICATIONS

*Lautsprecher-Taschenbush* (Loudspeaker Handbook), 1969, Isophon-Werke GmbH, Berlin, pp. 170-187.

"Horn Loud Speaker Design", by J. Dinsdale, *Wireless World,* Mar., 1974, pp. 19-24.

*Hi-Fi Loudspeakers & Enclosures* by Cohen, pp. 169, 205, 206, 232-234, 1956.

"Choosing Your Hi-Fi Speaker Enclosure", by Cohen, *Radio and Television News,* Dec., 1954, pp. 46, 47 & 120.

Isophon Bauanleitung 2, 2 pages.

*Loudspeakers* by Briggs, pp. 226 & 227, 1958.

*Primary Examiner*—Douglas W. Olms

*Attorney, Agent, or Firm*—Edwin E. Greigg

[57] ABSTRACT

A loudspeaker unit having an improved quality of bass reproduction for use in a stereo system with a second unit, which is a mirror image of it, to provide a better three-dimensional feeling on hearing the reproduced sound and to provide an increase in the area of the sound producer or source which includes a bass or woofer loudspeaker housed in a chamber, whose volume, together with the properties of the loudspeaker, is so designed that a desired resonant frequency is produced. An exponential horn is placed at an opening of the chamber, whose design is based on a Helmholtz resonator, whose captive air volume takes over the function of an active diaphragm, and the resonant frequency of the horn resonator has a specific relation to the resonant frequency of the chamber and the loudspeaker. Furthermore, a middle range loudspeaker is placed for radiation upwards at a slope, on a confining wall face of the horn, so that the medium frequency sound waves are reflected at a side wall of the reproduction room are increased. The tweeter loudspeaker, on the other hand, in each unit is turned somewhat towards the middle of the reproduction room, so that it is pointing straight towards the hearer, who will hear the radiated sound, without any loss in the treble output, directly as if it were coming from the original sound producer.

14 Claims, 10 Drawing Figures

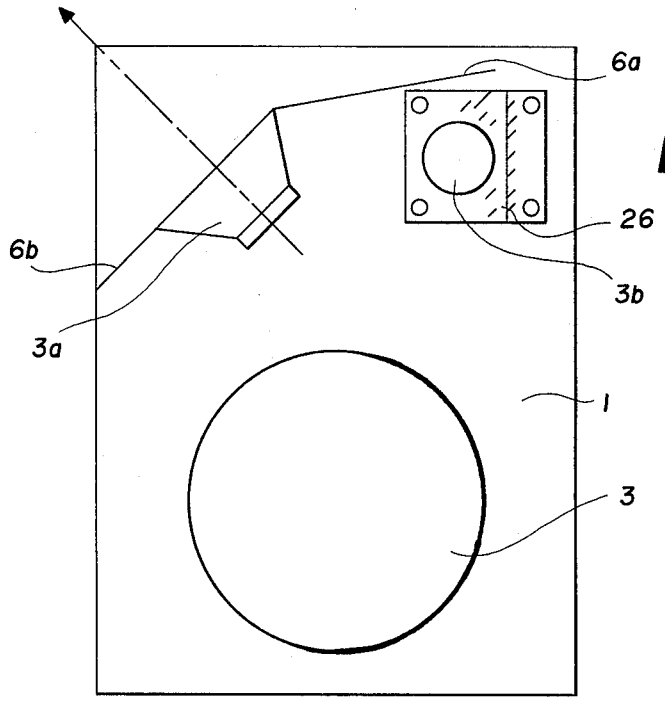
FIG. 6
FIG. 8
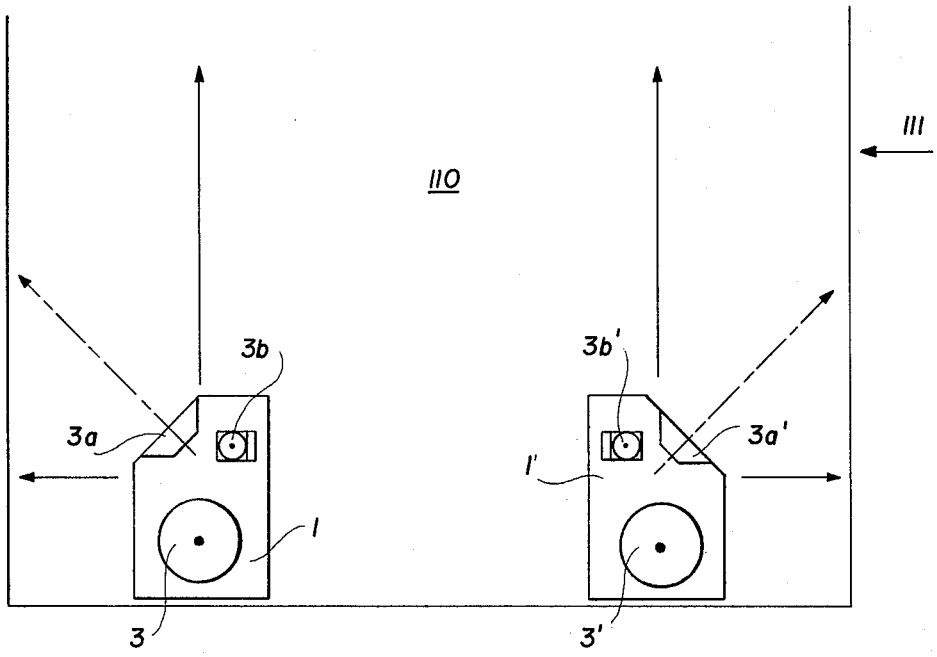

STEREOPHONIC SOUND REPRODUCING SYSTEM

BACKGROUND OF THE INVENTION

1. Special Field of the Invention

The invention relates to high-fidelity loudspeaker units designed more specially for undistorted reproduction of bass tones and whose three-dimensional reproduction is better than that of prior art loudspeaker cabinets and the space in which sound reproduction takes place seeming to be greater than its true size.

2. The Prior Art

In normal loudspeaker unit design, all single loudspeakers are fixed to a common support (or acoustic) wall for radiation forward. For reducing the shortcomings of a unidirectional characteristic in the case of high pitch or treble radiation, however, a number of different treble or tweeter loudspeakers have been placed with an angular spacing between them, i.e., angularly offset, so that their directional diagrams are overlapping over the greatest possible angle for producing the evenest possible acoustic radiation pressure. An extreme case of such a system is the so-called spherical loudspeaker unit in which a great number of single high-pitch or treble systems are placed on a generally spherical face, so that a generally regular omnidirectional radiation effect is produced. The structure of such a system is, however, very complex.

Furthermore, even before the development of true sterophonic reproduction, "3D sound" was publicized in advertisements, in which, in addition to the front loudspeaker, smaller loudspeakers were placed at the two side walls of a wireless receiver housing for radiation of the medium and higher frequency ranges. The purpose of this was to produce a more omnidirectional radiation of the medium and higher frequencies, so that the medium and higher frequency acoustic performances are not only sensed well in the front direction, but also to the side of the receiver.

For bass emphasis so-called bass reflex units or cabinets have been designed (see, for example, the Austrian Pat. No. 212,897), in which a low pitch or bass loudspeaker is placed on one wall of a chamber for radiation to the outside through an acoustic opening in this chamber wall, while the backside of the diaphragm of the loudspeaker is utilized for oscillation of the air within the chamber. The chamber has, in addition to the acoustic opening, a second opening, referred to as the reflex opening, which is connected with a duct having an air column in it, and which, in order to make the air column longer, may be bent a number of times. The duct is generally formed by an inner structure within the loudspeaker unit. Together with the air volume in the chamber and the diaphragm of the loudspeaker, this air column takes the form of an oscillating means whose resonant frequency is lower than that of shut or closed loudspeaker cabinets by the reciprocal of the square root of two, so that the overall cabinet or loudspeaker enclosure will be responsible for radiation even of low frequencies with a great displacement volume. However, in this case, the radiation face is in no way large enough in size. The size of a bass loudspeaker diaphragm for operation without distortion, must have the same size relation to the average backing wall behind the orchestra, as the musical instrument with the greatest face area to the backing wall of the auditorium, or, more specifically, as the average overall face area of the musical instruments used to the backing wall, this number being divided by the square root of the overall number of musical instruments being played. Diaphragms of this order of size will, however, be overly heavy and not stiff enough, contributing to further distortion. Furthermore, in this case, the volumes of the housings are excessively large.

As disclosed in the German specifications (Offenlegungsschriften) No. 2,111,581 and No. 2,116,962 and the Austrian specification No. 305,403, an attempt has been made to use inner housing parts for copying an exponential horn joined with a relatively small loudspeaker chamber and which is designed for emission of the sound, radiated from the back side of the diaphragm of the loudspeaker, while decreasing the radiation impedance at the back side of the diaphragm, over a large area and into the auditorium as well. These inner structures are, however, generally complex and high in price and, for this reason, have not been put into general use, particularly because the lower limiting frequency in such structures is generally high. In the case of a housing and horn, made smaller in size to be in line with more modern developments, the resonant frequency $f_o$ and the lower limiting frequency $f_G$ are even higher. In a third way of making a shorter horn, by way of compensation, the modulus of widening (m%) and the horn mouthpiece diameter $d_e$ are decreased once again for increasing the dynamic air weight. However, such a horn is responsible for producing a false pitch because standing waves are formed so that it has a "trumpeting effect".

Leaving this unsatisfactory line of development, the applicant herein first designed a loudspeaker unit referred to as a so-called "chamber horn," in which an exponential horn, decreased in size, is placed at the reflex opening of a chamber. The selection of the volume of the chamber together with the resonant frequency of the loudspeaker and the size of the connection opening (in this case the reflex opening has the effect of a low pass filter) between the chamber and the horn is designed to produce a desired low resonant frequency so that the exponential horn is responsible for substantially improving the radiation impedance matching (radiation face matching) of the chamber opening to the surrounding space in line with the impedance transformation properties of an exponential horn. Because of the chamber size noted earlier, the low base frequencies may be present at the connection opening to the horn with a relatively great oscillation amplitude and in-phase with the acoustic waves, radiated from the front side of the diaphragm, and the chamber has the effect of a pressure chamber as well because of this connection opening, the exponential horn for bass radiation may have very much smaller dimensions than would be necessary for a normal design of exponential horn loudspeaker for comparable bass radiation. So, using simple design measures, a good and powerful bass reproduction is made possible.

OBJECTS AND SUMMARY OF THE INVENTION

One of the objects of the present invention is to provide a loudspeaker unit having a design such that, particularly in the case of stereo reproduction, the three-dimensional range of the original acoustic performance may be sensed by the hearer in as natural a form as possible.

A further object of the present invention is to provide a loudspeaker unit having improved bass reproduction with the effect of decreasing the lower limiting frequency producing a more faithful reproduction of pulses without the need of a more complex design.

In one form of the invention for effecting these and other purposes, the medium pitch loudspeaker is designed for radiation at, in relation to the front direction, 90° sideways and within a range of 35° to 55° upwards. In particular, high-level effects are produced in the case of treble reproduction, if the middle axis of the treble loudspeaker (or tweeter) is turned through 18° with respect to the middle axis of the bass loudspeaker, with the medium pitch loudspeaker radiating towards the room wall and the treble loudspeaker pointing towards the hearer, the hearer is, as far as possible, in the middle of the directional lobe of the treble loudspeaker or tweeter. The system of the present invention for the loudspeakers in the loudspeaker cabinet will then, more particularly, provide a special life-like form of reproduction which, with respect to the range in space, is true to the original form of the acoustic performance, if use is made of a stereo system with two loudspeaker cabinets (or boxes) which, as part of the present invention, are mirror images of each other and whose medium pitch loudspeakers are placed for radiation towards the side walls of the room used for reproduction.

One aspect of the invention is now to be presented in more detail with a discussion of the various considerations on which it is based.

Because the conditions of radiation of the first or original acoustic event (performance) are, it is clear, not in existence in the case of loudspeaker reproduction, attempts have to be made to copy these conditions. In fact, each single musical instrument—for example one of the musical instruments of an orchestra—is responsible for a radiation field in the form of a spherical wave. All these spherical waves taken together will be responsible for a general or overall spherical wave as an acoustic field. Because, however, a loudspeaker cabinet is not a productive instrument, but is, in fact, a reproductive instrument—if it is to be part of a reproduction system—in the case of stereo reproduction, it is not proper to take into account only its acoustic field alone and, in fact, the spherical wave which is produced by the two loudspeakers together must be considered. This spherical wave, as far as possible, has to be quite the same as the original acoustic field.

Because the radiation characteristic of a loudspeaker or of a loudspeaker cabinet (or box) is not the same as that of the original acoustic producer, and, in fact—frequency-dependently—is different from it, so that it must be corrected. The spherical wave coming from the original acoustic performance undergoes radiation in all directions without bing dependent on the frequency, so it is characterized by a completely true spherical characteristic. It is therefore important that, during reproduction, the front part of the spherical wave be reproduced as truly as possible, while the back part of the spherical wave is, in generally used systems, nearly completely absorbed or is reflected with a time delay so short as not to be sensed, i.e., any effects of different transit times or lag are in the program signal itself and will undergo radiation like it. A loudspeaker, however, sends out its acoustic field frequency-dependently with different directional characteristics. While the lowermost frequencies are sent out as in the original form, even the radiation field of the medium frequencies (up to about 4 kHz) is kidney-like in form, while the radiation characteristic of the highest frequencies is lobed. This is an undesired effect for the reproduction of a natural sound picture.

A room for an original performance, which is normally large and highly anechoic, is very different from normally used reproduction rooms, which are mostly small in size and have generally poor anechoic properties. This is because of the size and, for this reason, the amount of air in the reproduction room, and because of the small time lag or transit time of the reflections taking place in the reproduction room. In the design of loudspeaker units, the general objective is to correct the undesired different properties in the room cahracteristics between that of the original performance, on the one hand, and that of reproduction, on the other hand, to a great degree so as to obtain a natural sounding, three-dimensional sound picture.

If two loudspeaker units of a stereo-pair to be used for radiation of a spherical wave of the type present in the original acoustic performance, they have to be looked at as a single unit. More specifically, the base of the radiation breadth is limited by the base of the placing of the loudspeaker units (distance between loudspeaker units), so normally, no room or sounding body, for example, a concert auditorium or a symphony orchestra, may be reproduced by them; this is also true for a solo instrument, which is to be played in a room of great size. While the acoustic effects between the two loudspeaker units or cabinets may, as a general rule, be said to be quite true to life, made worse by any changes, the strong indirect acoustic field (indirection field) and the broader base of the natural performance room is to be produced by tricks outside the range of the two stereo loudspeaker units, i.e., from the side walls and the ceiling of the room used for reproduction. If the effect of a smaller room is to be reproduced, this base spread in the case of the loudspeaker system is not produced as long as the dimensions of the smaller space are not greater than the base of the placing of the loudspeaker units.

To produce a spherical wave as true to the original as possible, with the help of loudspeakers, it is also necessary for the radiation base of those frequencies which are radiated by the loudspeaker with an excessively small space angle to be made broader. Because there is a question concerning up to about 4 kHz of the same frequencies which are to be reproduced, and because of the three-dimensional reproduction noted earlier as well with a broader radiation base, the same correction measures may be used in this respect as well. The lower and medium frequencies are radiated broadly enough and, in any case, their direction cannot be sensed. The somewhat higher frequencies (coming from the medium range loudspeaker) starting at about 800 Hz, are radiated mirrorwise about 90° outwards to the side and about 45° upwards. This very great angular range of the direction of radiation by the respective positioning of the medium range loudspeaker is responsible for the acoustic deflection given the necessary effect and taking into account that, in comparison, for example, with light, sound has a generally great wavelength. For this reason, the resulting outcome is that:

(a) the base is clearly made broader and (b) the delay in the transit time produced by this (still in relation to the relatively great wavelength of sound) is responsible for compensating for the different room size.

Frequency range starting at 4 kHz

The sense of direction and the property of the ear in hearing differences in transit time become better with an increase of frequency. Furthermore, the highest frequencies are not only very strongly absorbed on reflection, but even in the direct acoustic field, they are more strongly absorbed by passive oscillation of the air. Because of the property noted of the ear with respect to sound starting at 4 kHz, the smaller reproduction room is clearly sensed as such and, for this reason, in the case of the same process for sound starting at 800 Hz (indirect radiation), the opposite effect to that of the desired effect would be produced. So, for all these reasons, the highest frequencies (starting at 4 kHz) radiated by the treble loudspeaker are best when not indirectly radiated but rather when radiated straight forward and, as far as possible, towards the hearer. In this respect the acoustic pressure curve is linear.

For producing a good stereo effect in general use, it is best for the hearer to keep within a distance range from the base line of the two loudspeaker units between half and $1\frac{1}{2}$ times the loudspeaker spacing. If c is used for the loudspeaker spacing, that is to say the length of the base line, and $h_c$ is used for the middle distance of the hearer from this base line (as the height of a triangle of the base line c between two corners in which the loudspeaker units are place, in the case of which the third corner of the triangle is formed by the hearer), it is then best for the distance range of $h_c$ to be between 0.5 c and 1.5 c. In the case of the greatest distance ($h_c$) equal to 1.5 c, the sides of the triangle, running from the hearer to the two loudspeaker units, will make an angle with the middle vertical line $h_c$ of, in each case, about 18°. It is then useful for the treble loudspeakers of the loudspeaker units, placed parallel to the back wall of the reproduction room, to be turned inwards by this angle (18°), so that the hearer, when at the greatest distance, as discussed above, from the loudspeakers, is exactly at the point of crossing of the loudspeaker axes, i.e., in the middle of the radiation lobes. If the hearer goes nearer to the loudspeakers, he will then be going out from the greatest radiation direction. However, the damping of the radiated sound by the air molecules of the room will be less, so that the decreased acoustic power, outside the middle of the lobe, will be compensated for. In the case of sideways motion of the hearer as well and in the case of such a placing of the treble loudspeakers, the hearer will generally not be in a range of relatively steep fall in acoustic pressure (as at the sides of the lobe), but will more be in the range of the highest level parts of the lobes, where the acoustic pressure is relatively even. So, generally, a relatively even acoustic pressure is produced, even with respect to the higher frequencies, in the reproduction room.

A further desired effect of treble loudspeakers not pointed towards the side wall, but radiating into the reproduction room, is to avoid the side wall reflection for the upper frequencies which, otherwise, in the case of radiation of substantial amounts of acoustic power towards the side walls, may still have a bad effect on the lucidity of the acoustic picture by different tones from residual reflexes even with the noted absorption effects.

For the positioning of the treble loudspeakers, it is best for them to be placed on a separate inner structure of the unit, which between its fixing face on the acoustic wall or baffle and the fixing face for the treble loudspeaker makes an angle of 18° and, dependent on the desired placing of the loudspeaker unit—upright or horizontal—may be so fixed to the acoustic wall, that the treble loudspeakers are responsible for radiation, as described above, towards the middle of the reproduction room. For example, the fixing holes of the inner structure may be placed at the corners of a square, so that the unit may be removed and then secured to the acoustic wall again after being turned through 90°.

In a further aspect of the invention, use is made of the theory of a Helmholtz resonator, whose completely captive air volume undergoes oscillations as an active diaphragm at its resonant frequency in accordance with its dimensions. Taking, for example, a cylindrical Helmholtz resonator, for a certain resonant frequency, for each diameter, the necessary length may be worked out and for all these groups of two sizes, the resulting Helmholtz resonators have the same "dynamic air weight".

In accordance with the invention, starting with an appropriately selected Helmholtz resonator, i.e., making a selection with respect to the cross-section and diameter of the resonator, and by proportionally increasing its length and its diameter towards the surrounding room while keeping the dynamic air weight (without the air weight being changed), it is possible for a horn-like resonator (referred to as a "horn resonator") to be produced which has the same resonant frequency as the base-Helmholtz resonator (now referred to as base-resonator as well) and its "captive" air volume undergoes oscillation as an active diaphragm similar to that of a Helmholtz resonator. Furthermore, this horn resonator, because of the horn-form, has the property of producing a better radiation impedance matching (better radiation face or surface matching) between its horn neck opening and its horn mouth opening. For this reason, the loudspeaker unit of the invention has the double function of an oscillating air diaphragm for the area of the horn mouth and better impedance face or area matching between the chamber opening and the reproduction room. Such a relatively small horn is a fully functioning structure, because its neck opening with the starting diameter $d_o$ (as is the case with the chamber horn noted earlier) functions as a pressure chamber (so that there is the horn decrease in size factor) and as a low pass filter. This makes bass reproduction significantly better. It is not only possible, for the given dimensions of the chamber, for the lower cut-off frequency to be designed lower, but pulse reproduction is obtained which is truer to the signal and more free of distortion, a factor which is particularly important in the case of musical performances. So the best possible relationship is produced between the low base-resonance and good matching of radiation in line with the surrounding space or room.

A further possible step for changing a Helmholtz resonator, which in its base form is cylindrical, and while keeping the dynamic air weight, to make a horn resonator, is to keep the length of the Helmholtz resonator unchanged and make the diameter of its one end opening larger on a scale as desired and, at the same time, the diameter of its other opening is decreased in such a way to obtain even more accuracy, i.e., with respect to the smoothest possible frequency response and the best possible matching of the radiation impedance of the structure made up of the loudspeaker, the chamber and the resonator to that of the surrounding room or space, than with the proportional increase, as discussed above, of the length and diameter of the Helmholtz resonator and its dynamic air weight. For this reason, its lower resonant frequency is kept unchanged. This is done by determining what increased lower resonant frequency is produced with a Helmholtz resonator of the same length but with the desired end diameter $d_e$ (horn mouth). Then a third Helmholtz resonator is sought, whose lower or bottom resonant frequency—with respect to the same resonator length—is, by the difference between the first and the second Helmholtz resonators, below the resonant frequency of the Helmholtz resonator (base resonator) taken as a starting point. The diameter of this third resonator will then have the starting or neck diameter $d_o$ of the desired horn resonator, whose resonant frequency $f_o$ is, for this reason, equal to that of the base resonator.

In such a system design, as with the previously referred to, the resulting horn resonator is the right one whose dimensions $d_o$, L and $d_e$ have the same relation to each other as the parallel values of an exponential horn with the original size for the same purpose of use (with respect to $f_G$).

In a form of loudspeaker unit designed with these principles in mind there is a dividing up of the housing with a separating wall into a chamber space and a horn space which becomes wider and wider from the chamber opening formed in the separating wall and through which the chamber is joined with the horn neck, dependent on the separating wall with the necessary design, to the horn mouth placed in the housing. In this manner, the design is simple, because, in addition to the housing walls, it is in general necessary only to have the separating wall formed in accordance with the principles of the invention.

It is best for the loudpeaker to be placed away from the middle of the housing and, furthermore, for the chamber opening to be placed in the separating wall outside the back radiation field of the loudspeaker. Furthermore, it is useful for the edge lengths of the chamber to have a relationship between them equal to one to the square root of two to two, for the chamber walls not to be parallel to each other, while generally keeping to the relationships noted, and, if necessary, for the chamber to be lined with damping material. All these measures are for obtaining an improved desired frequency behavior and the elimination of undesired resonances and standing waves, etc.

The invention will be better understood as well as further objects and advantages thereof become more apparant from the ensuing detailed description of a preferred embodiment of the invention, taken in conjunction with the drawings.

BRIEF DESCRIPTION OF THE DRAWINGS

FIG. 6 is a diagrammatic front view of a loudspeaker unit incorporating the teaching of the invention.

FIG. 8 is a diagrammatic view of a stereo system with two loudspeaker units of the type shown in FIG. 1 and FIG. 2 arranged as mirror images of each other.

DESCRIPTION OF THE PREFERRED EMBODIMENTS

Figure 1:
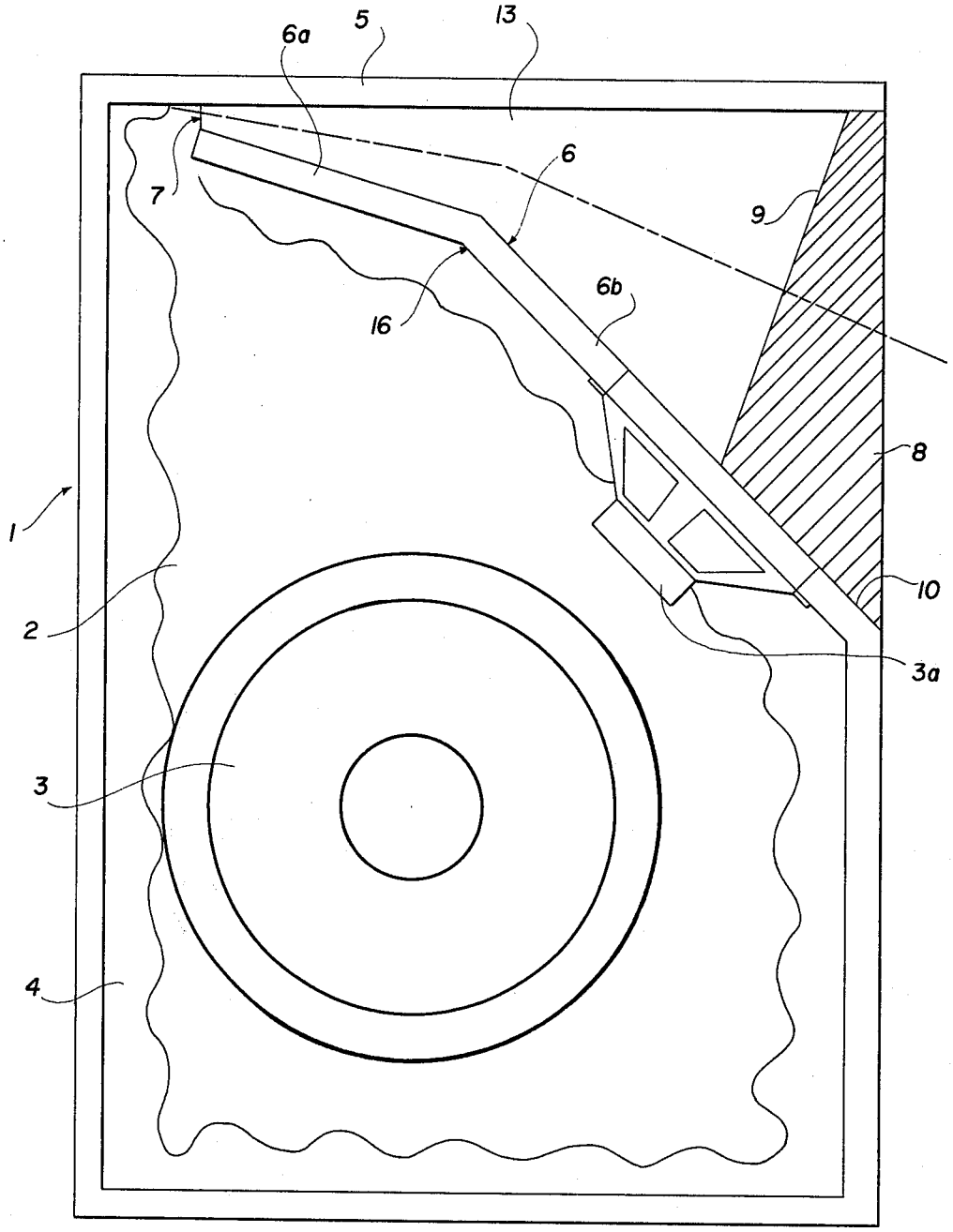
FIG. 1 is a diagrammatic sectional view of the loudspeaker unit of the invention.

In FIG. 1, there is shown a loudspeaker unit having a housing or cabinet 1, illustrated in the form of a sort of x-ray picture. Inside the housing 1 there is a chamber 2, which generally takes up the lower part of the housing. Displaced from the center of the housing on the front wall, a bass or low-pitch loudspeaker 3 is placed. To be free of housing resonance, the edge lengths of the chamber 2 are dimensioned to provide a relationship between them equal to one to square root of two to two and the chamber is lined with damping material 4.

In the top part of the housing 1 there is a horn-like resonator 13, referred to hereinafter as a "horn resonator". The resonator 13 is limited or walled off by the top housing wall 5, the inside separating wall 6 and by the front and back walls of the housing. The separating wall 6 is made up of two parts **6*a* and 6*b* placed at an angle to each other and which are responsible for the widening of the Helmholtz resonator as a horn resonator. Because the top wall of the horn resonator is formed by the flat housing wall 5**, the horn resonator is not straight but bent, as is made clear by its broken, bent middle line.

On the top left of FIG. 1 at the horn neck, the chamber opening 7 is seen as a connection between the horn 13 and the chamber 2. To the right there is the horn mouth 8, whose outline is marked by shading. The captive air volume in the horn resonator 13 undergoes oscillation bodily as an active diaphragm in phase with the bass loudspeaker diaphragm and, for this reason, is responsible for significantly better driving of the air, outside the loudspeaker unit, within the reproduction room, than is the case with driving using only one loudspeaker diaphragm (is one half of the area). The reason is because of the better matching of the sound coming out through the chamber opening 7 from the chamber 2 into the surrounding room as is the case in old exponential horns for better matching of the acoustic power of the loudspeaker diaphragm placed at the horn neck with the surroundings.

It will be seen from FIG. 1 that the horn resonator may be designed in a very simple way by the use of the bent separating wall 6 in the loudspeaker housing 1 without complex inner structures being necessary, as are in fact used in the earlier design previously discussed inasfar as they make use of horn-like acoustic guides. Furthermore, part **6*b* of the separating wall is used as a support and fixing face for a medium-range loudspeaker 3*a*, radiating upwards at a slope through the horn mouth 8. The horn mouth 8 is somewhat on a slope in the housing as can be seen in FIG. 1 so that the sound coming from the horn mouth may, even if the loudspeaker unit is placed near a wall, be radiated into the surrounding room as freely as possible. The sloping horn mouth 8 is produced because the front housing wall has a cut-back configuration in the form of the edges 9 and 10**.

Figure 2:
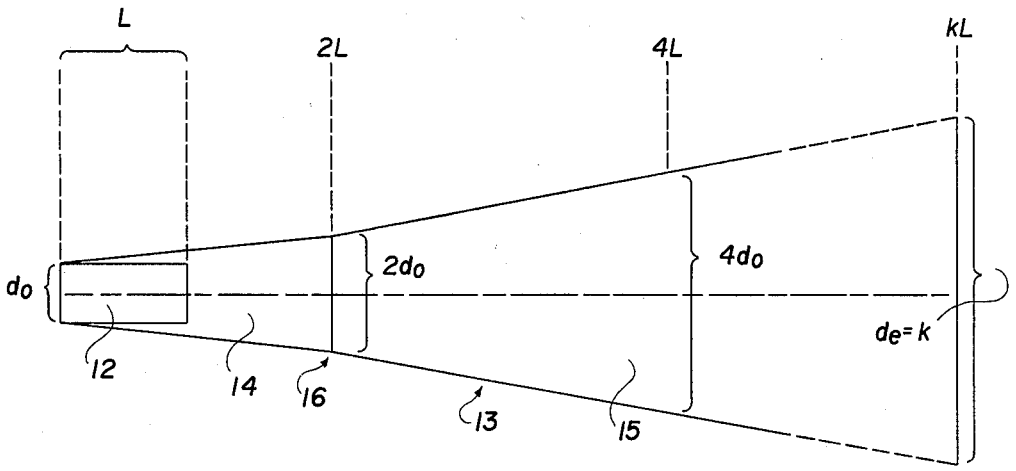
FIG. 2 is a diagrammatic view of a horn resonator made by widening a Helmholtz resonator.

With reference to FIG. 2, the description below is directed to the widening of a Helmholtz resonator for forming a horn resonator. Starting with a desired size of the loudspeaker unit, the chamber volume is first worked out and fixed and a selection is then made of the necessary sort of loudspeaker (a low-pitch loudspeaker or woofer with the necessary power, having a low figure for non-linear distortion and a generally stiff diaphragm, the appropriate resonant frequency and diaphragm diameter). Using the computations for the housing volume and the data of the loudspeaker, the resonant frequency (referred to hereinafter as the base-frequency as well) of the structure made up of the loudspeaker and chamber, may be worked out generally using the equations below:

$$S_L = \frac{4.03}{1000} f_{oCh}^2 \cdot m$$

$$S_G = \frac{11000 \cdot r^4}{V}$$

$$f_o = f_{oCh}\sqrt{\frac{S_L + S_G}{S_L}}$$

in which $f_{oCH}$ is the resonant frequency of the loudspeaker, r is its diaphragm radius in meters, V is the air volume of the chamber in cubic meters and m is the diaphragm mass (with the voice coil and the diaphragm support systems) in grams.

Because of the chamber opening, this base-frequency, which is true for a shutoff chamber, is changed by the factor of the reciprocal of the square root of two, so that the base-frequency $f_{oÖ}$ or $f_G$ for the chamber, having the chamber opening as a connection with the horn resonator, with the loudspeaker is now:

$$f_G = \frac{f_o}{\sqrt{2}}.$$

If it turns out that this base-frequency is excessively high, the starting or base-values of the equation will have to be changed as necessary, i.e., the chamber volume will have to be changed or, and this is generally the better step because the housing volume is generally fixed beforehand, another loudspeaker will have to be used, for example, one with a softer diaphragm support system, and the computations are then worked out again. It will then be possible for a value of the base-frequency generally equal to the desired base-frequency to be produced by experimentation, if necessary, a number of times.

Starting with this base-frequency, normal tables or diagrams are then used for making a selection of a Helmholtz resonator for working out the design of the horn resonator. Diagrams for fixing the dimensions of Helmholtz resonators at different resonant frequencies are given for example in the book "Das Lautsprecherbuch" by Jürg Jecklin, published by Franckh'sche Verlagsbuchhandlung W. Keller & Co., Stuttgart 1967, on page 93. At this point, it should be noted that with respect to the question of the size of the chamber opening, in the book "Kleines A B C der Elektroakustik" by Gustav Büscher, published by Franzis-Verlag, Munich 1967, on page 39 and in other parts of this book, reflex openings for bass reflex housings have been worked out. For the selection of a particular Helmholtz resonator with the selected base frequency, it is generally the dimensions of the loudspeaker housing which are important, because, in fact, the horn resonator, whose design is based on that of a Helmholtz resonator, is to have its place in the housing.

FIG. 2 is provided to make clear, starting with the Helmholtz resonator having the diameter $d_o$ and the length L, that the horn resonator 13 is designed by widening to a horn-like structure while keeping the dynamic air weight constant. If the starting diameter $d_o$ of the Helmholtz resonator is increased with a doubling of the length to 2L, to the double value $2d_o$ as well, the outcome is a horn base-pipe 14, which has the same dynamic air weight as the cylindrical Helmholtz resonator 12 shown in FIG. 2. This dynamic weight of the captive air volume in the resonator is maintained even if the base-pipe 14 is made even greater in size with a proportional increase in its length and its diameter.

First, in FIG. 2, further dimensions are shown including an increase in length to 4L together with an increase in the diameter to $4d_o$, and then a further increase in length to the final diameter $d_e$ with a factor of $k \cdot d_o$ while, at the same time, having an increase in length to k·L. The funnel or trumpet part 15 is shown coming after the base-pipe 14 of the horn, is numbered 15. At the connection point, there is a sudden change in slope or a bend 16, similar to that shown in FIG. 1 between the separating wall parts 6a and 6b. Because the dynamic air weight is the same in the two cases, the resonant frequency of the horn resonator 13 of changed design is the same as that of the Helmholtz resonator 12.

If a change or increase in size of the horn resonator up to the diameter $d_e$ equal to the diaphragm diameter of the loudspeaker 3 is in order, designing of the horn resonator will be at an end and the resonator may be made in the box with the worked-out dimensions. In this respect, for the sound radiated backwards from the loudspeaker, the same radiation conditions are produced, generally speaking, as for the sound radiated from the front side of the diaphragm, the radiation being in phase. For this reason, the bass power output radiated from the loudspeaker unit as a whole is so great as to be equal to that of the loudspeaker unit of the answer reflex type, that is to say, generally speaking, twice as great as is the case with a shutoff loudspeaker unit or box. In addition to this desired effect, because of the 100% better matching of bass radiation into the surrounding space, there is a changing of the input electrical power into acoustic power which is truer to the input signal and is lower in distortion, something which is responsible for a better pulse behavior, i.e., say a truer reproduction of pulse-like oscillation performances. This is, for example, very important in the reproduction of music. Practical testing has made it clear that there is no longer any change in sound and no other form of distortion. In fact, a pure and lucid reproduction is made certain right down to very low bass notes.

For obtaining an even further increase in the efficiency, which is to be produced particularly for lower frequencies in the interest of having balanced and powerful reproduction, the horn resonator may be increased in size, i.e., changed in design to have a greater end diameter than the diaphragm diameter of the loudspeaker in the way discussed above. A horn resonator of greater size may be placed in a loudspeaker housing of small dimensions, for example, by folding, although, however, this makes the inner structures somewhat more complex.

In this respect, a further possible step is that of changing a horn resonator, increased in size past the diaphragm diameter of the loudspeaker, in a certain way relative to its dimensions, i.e., the proportionally equal relation with the dimension values of an exponential horn in the original size is to be determined, whose base-frequency $f_G$ may be half an octave higher or lower than $f_o$ö. First, for this purpose, an old design of horn is made, whose neck diameter $d_o'$ is equal to the diaphragm diameter of the loudspeaker and whose horn mouth diameter $d_e'$ is designed for complete matching of the available power at the horn neck, with respect to the surrounding room using the formula $d_e' = 109.43/f_G$ in which $f_G$ as the horn base frequency is preferably exactly half an octave lower or higher than the resonant frequency $f_o$ discussed previously with respect to the chamber with the loudspeaker in the case of the chamber opening. The length of the exponential horn is worked out using the formula $l' = (d_e'/2) \ln (d_e'/d_o')$ (the widening factor (m) for the e-function-form curve of the horn is then equal to $0.0365 \cdot f_G$ in %). Such an exponential horn is naturally excessively large in size for a loudspeaker unit of the type to be used in the home. For the present use, the horn is first decreased to the necessary size. This is done by proportionally decreasing the dimensions (neck diameter, mouth diameter and length) until the neck diameter of the decreased exponential horn is the same as the neck diameter, dependent on the Helmholtz resonator used as a starting point, of the horn resonator.

The next step is to make the horn resonator congruent with the decreased exponential horn, it being necessary not only for its neck diameter but also its mouth diameter and its length to be with the parallel values of the decreased exponential horn. Such a congruent condition is possible because, at an unchanging resonant frequency, the length of a Helmholtz resonator is not changed proportionally with its diameter and, in fact, in the case of a relatively small change $d_o$ in diameter, a generally large change in its length L takes place. So if the horn resonator, whose neck diameter is the same as that of the decreased exponential horn, is now, for example, longer than the decreased exponential horn, but, however, the horn resonator wall is formed by cutting the decreased exponential horn at $d_e$, the horn resonator may be terminated, i.e., cut off, to correspond with the length of the decreased exponential horn. The dynamic air weight is not changed for the reasons made clear earlier, so that, for this reason, the neck diameter, length and horn mouth diameter of the horn resonator and of the decreased exponential horn will be the same. Normally, however, the mouth diameters are still different.

For producing agreement in this respect as well, it is necessary, in accordance with the type and size of the differences in the mouth diameters, to make a selection, using the diagrams discussed above, of another Helmholtz resonator for the same resonant frequency and the design process discussed above has to be repeated. Because the diameter and length changes are not, as discussed above, proportional to each other in the case of a Helmholtz resonator, for a certain resonant frequency, it is in fact possible in this way for the right type of Helmholtz resonator to be worked out as a starting point for a horn resonator, which, with respect to neck diameter, mouth diameter and length, is the same as the decreased exponential horn. In this respect, as well, the changes or departures in the horn form are compensated for, i.e., after a smaller degree of widening of the exponential horn after the neck, there is a greater one before the mouth, because $d_o$ and $d_e$ are the same in the two cases, thus, the desired double function of the horn resonator is effected, on the one hand, functioning as an active diaphragm with its whole air volume and, on the other hand, being responsible for a better acoustic matching between the horn neck and the horn mouth.

Using the diagram of FIG. 3, the theory of decreasing the horn resonator size will be made clear. The exponential horn 20 make in the original size and taking the diaphragm diameter 2R of the loudspeaker as a starting point, is marked in broken lines. From this original exponential horn, a proportional decrease in size in its dimensions (neck diameter, mouth diameter and length) has been effected for producing the decreased exponential horn 21, whose neck diameter $d_o$ is the same as the neck diameter of the horn resonator 13. In the case shown, the horn resonator 13 has its length extending past the length of the decreased exponential horn 21 and on cutting down to the length $l_E$ of the horn 21, its mouth diameter, which, in the first place, might have been greater than the mouth diameter of the decreased exponential horn 21, is then, however, smaller than the horn 21. So taking the original Helmholtz resonator, it is not possible to have an agreement of all three dimensions (neck diameter, mouth diameter and length) so that as a starting point, it is necessary to have another Helmholtz resonator of the same resonant frequency.

Figure 3:
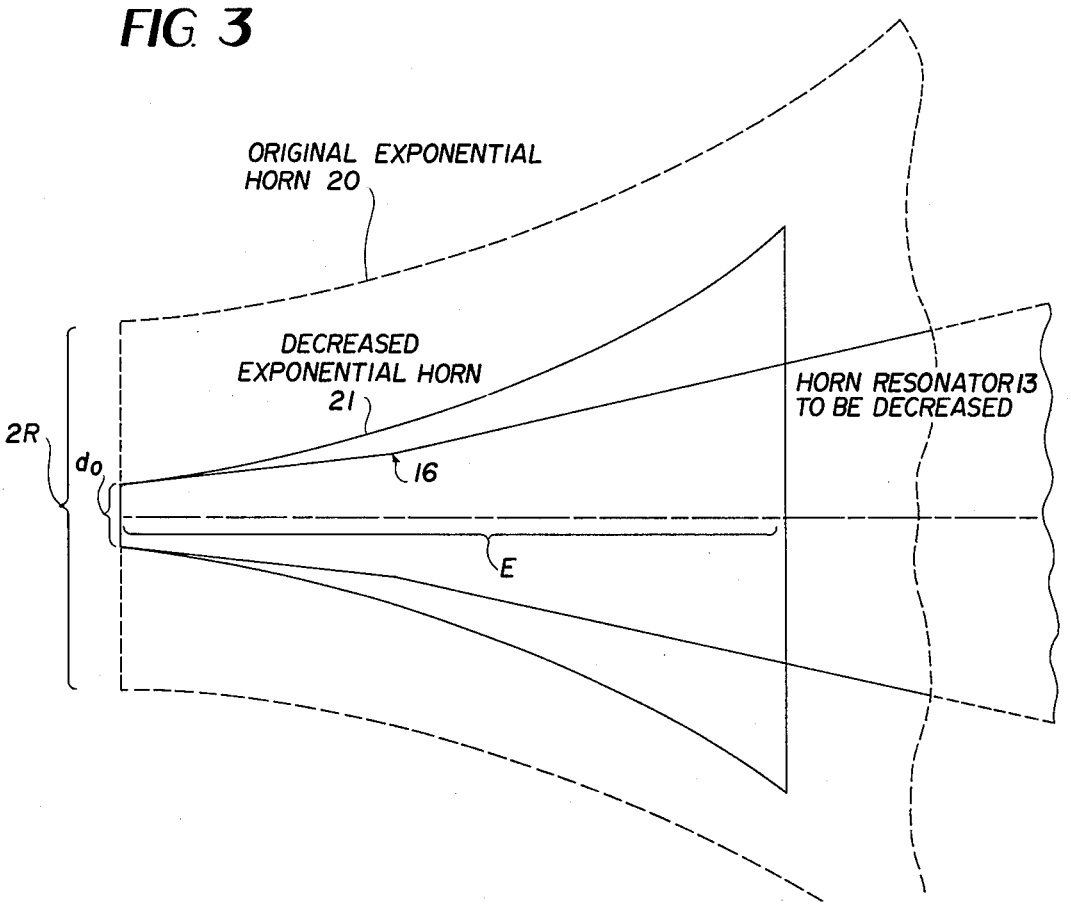
FIG. 3 is a diagram for illustrating the decrease in size of a horn resonator to provide the dimensions of a small-size exponential horn.

If, in the example shown in FIG. 3, the selection is made of a Helmholtz resonator with a shorter length L because of the relationship discussed above, its diameter will only be a little smaller, so that, dependent on this decrease in diameter, the decreased exponential horn 21 (on a proportional scale) will, as well, only be a little smaller. While the mouth diameter of the horn resonator, because of the proportional relationship (proportionality factor k as in FIG. 2) has become smaller to the same small degree as the neck diameter of the horn resonator, its length will, on the other hand, have become very much smaller, because the length L of the newly selected Helmholtz resonator has been decreased to a very much greater degree than its diameter. The length of the new horn resonator produced by widening the newly taken Helmholtz resonator will now be very much more in line with the length $l_E$ of the decreased exponential horn, so that very much less need be cut off from the horn resonator. For this reason, the mouth diameter at the point of cut off is accordingly greater than in the previous case, i.e., even in this respect there is an improvement of the congruence sought.

If necessary, an even shorter Helmholtz resonator of the same resonant frequency must be taken as a starting point and then the complete process must be gone through once again. On the other hand, however, there may be a case such that the length of the second Helmholtz resonator selected is excessively short, so that the length of the horn resonator made from it by widening is smaller than the length $l_E$ of the decreased exponential horn. Then, the horn resonator needs to be made longer as far as this value, in which respect its mouth diameter will naturally be increased. In each case, however, it is possible to make the congruence of the neck diameter, the mouth diameter and the length as true as may be desired between the horn resonator and the decreased exponential horn, something which is readily possible graphically by making tests or, the same objective may be effected mathematically.

There is another way which provices an even better effect for changing a Helmholtz resonator into a horn resonator. The values $d_o$ (neck diameter), L (length) and $d_e$ (mouth diameter) of the horn resonator to be made congruent to the exponential horn with respect to these values are worked out in the following way. However, some observations on some general processes of thought in this connection appears appropriate at this point.

Decrease in the cross-section at one end of a Helmholtz resonator down from its first diameter d to a desired neck diameter $d_o$ of the horn resonator to be designed makes it necessary, in order to keep the dynamic air weight unchanged (keeping the resonant frequency unchanged), to provide dependent decrease in the air captive in the resonator. This may be accomplished by decreasing the resonator length L while keeping the cross-section unchanged at the other end or, however, increasing the cross-section at the other end while keeping the resonator length L unchanged. When the horn neck or horn mouth diameter $d_o$ or $d_e$ respectively is used in place of cross-sectional areas to make the process simpler, this has no effect on the outcome. Of the two possible ways of maintaining the dynamic air weight and, for this reason, the base-frequency, the increase in the horn mouth diameter is more desirable because of the better matching of the radiation face or area and because in this case the "air diaphragm" is increased in size, this being an important point in connection with a horn resonator.

Figure 4:
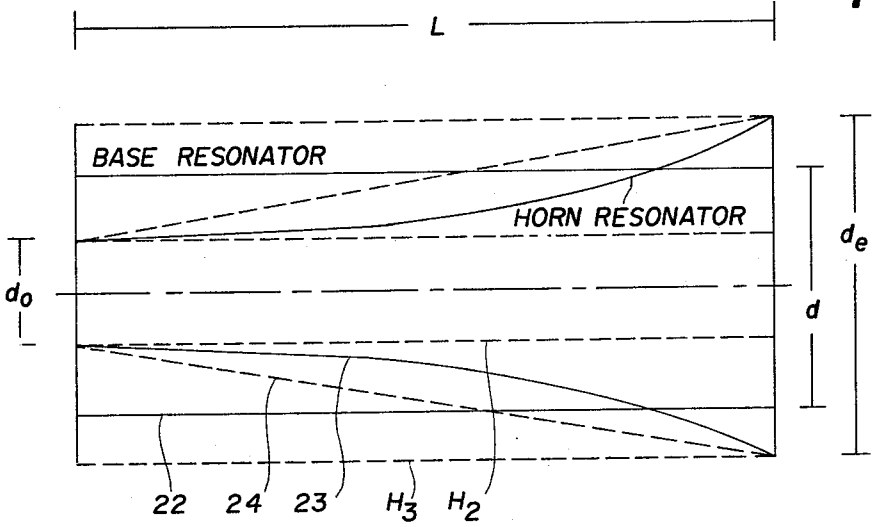
FIG. 4 is a diagrammatic view of a variation in the change of a Helmholtz resonator for making a horn resonator with more exact properties.

For the design of the horn resonator, the starting point is again the Helmholtz resonator, whose resonant frequency, as in last case, is equal to the resonant frequency $f_o$Ö of the loudspeaker and the chamber with the opening. In this respect, a Helmholtz resonator is sought (for example, using the Jecklin table) with a table, which is generally equal to the desired length of the horn resonator. This Helmholtz resonator, which is numbered 22 in FIG. 4, is the starting point of the design and is referred to as the base-resonator. Now the diameter d of this base-resonator is increased to the desired mouth diameter $d_e$ of the horn resonator keeping in mind that a further Helmholtz resonator ($H_3$ in FIG. 4) of diameter $d_e$ and of the same length L and resonant frequency $f_{G3}$ is worked out of this second Helmholtz resonator. In this respect, it is to be noted, that a horn resonator, functioning as a resonator, has a resonant frequency ($f_o$) and, functioning as a horn, has a base-frequency ($f_G$). In the case of a horn resonator, $f_o$ is now equal to $f_G$, to that, for simplification, the symbol $f_G$ may be used in all cases—as in the case of the design as well. This resonant frequency $f_{G3}$, because of the greater diameter, is higher by an amount $\Delta f$ than the resonant frequency $f_{G1}$ of the base resonator 22. This difference $\Delta f$ is now substracted from the resonant frequency $f_{G1}$ of the base resonator, so that the outcome in the end is a further, lower resonant frequency $f_{G2}$.

The next step is that of again using the table or parallel diagrams discussed again for working out what the diameter is of a Helmholtz resonator of the same length L as the base-resonator and as the Helmholtz resonator $H_3$ for this base-frequency $f_{G2}$. This diameter is then the neck diameter $d_o$ of the horn resonator to be designed which has the same length L as the base-resonator and which, because of the connection between the increase in its horn mouth cross-section or area and the decrease in size of its horn neck cross-sectional area has the same dynamic air weight and, for this reason, the same resonant frequency as the base-resonator. In broken lines in FIG. 4 a frustum of a cone is marked (in theory), which has the length L, the neck diameter $d_o$ and the mouth diameter $d_e$. These three values are, as in the present case, those magnitudes for which there will be congruence with an exponential horn.

Figure 5:
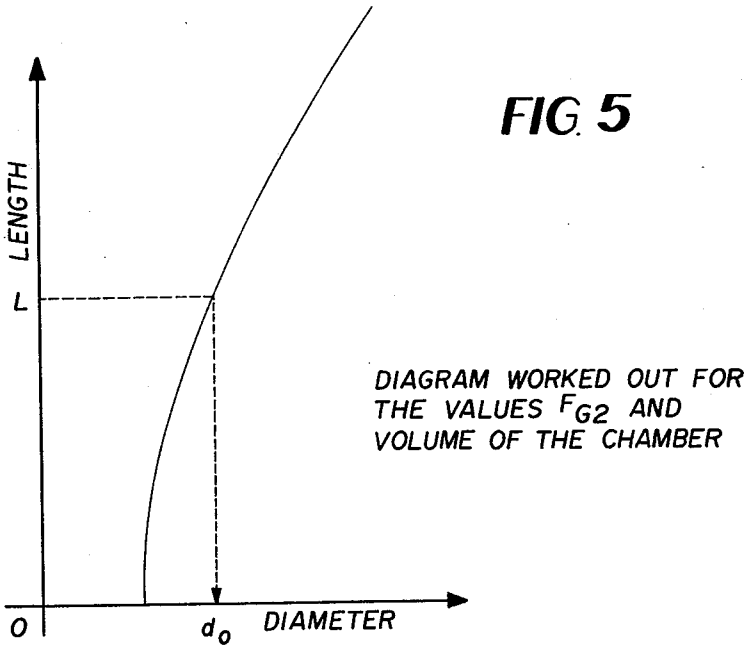
FIG. 5 is a diagram for determining the dimensions of a Helmholtz resonator at a given resonant frequency.

A detailed account will now be given of a change in design of a Helmholtz resonator for producing a horn resonator in line with the second possible form of FIG. 4 and FIG. 5. Using a table (as, for example, as given in the book by Jecklin) as in FIG. 4 as a base-resonator 22, a selection is made of a Helmholtz resonator of the desired length L and the resonant frequency $f_{G1}$. This base-resonator 22 has the diameter d. In addition to the values L and $f_{G1}$, based on the size of the design of loudspeaker unit, it is generally possible for the horn mouth cross-sectional area and, for this reason, the horn mouth diameter $d_e$ to be worked out (in most cases the horn mouth diameter will be taken to be of the same order of magnitude as the diaphragm diameter of the loudspeaker).

So, as in FIG. 4, a drawing of a further Helmholtz resonator $H_3$ is made on top of the base-resonator 22 having the same length L as the base-resonator but with the desired greater diameter $d_3$ of the horn mouth. For this Helmholtz resonator $H_3$ with the diameter $d_e$, the dependent resonant frequency $f_{G3}$ is looked up in the table and it will be seen how much higher the frequency difference $\Delta f$ is than the resonant frequency $f_{G1}$ of the base-resonator 22.

The difference $f_{G1}-\Delta f$ is now worked out to give a smaller resonant frequency $f_{G2}$ which may be worked out with the equation:

$$f_{G2}=2f_{G1}-f_{G3},$$

because in fact $f_{G3}-f_{G1}=\Delta f=f_{G1}-f_{G2}$. For this resonant frequency $f_{G2}$, the table (or a diagram) as in FIG. 5, which gives the connection between the length and diameter of a Helmholtz resonator of the frequency $f_{G2}$ (for a certain housing volume), is used to see what the diameter $d_o$ is of a Helmholtz resonator of the base-frequency $f_{G2}$ and of the same length L as the two other Holmholtz resonator. This last Helmholtz resonator worked out is seen in FIG. 4 and identified by the letter $H_2$. Its diameter $d_o$ is the neck diameter of the desired horn resonator with the mouth diameter of $d_e$ with the same length, the same dynamic air weight and the same resonant frequency $f_{G1}$ as the base-resonator 22. Thus, the three dimensions $d_o$, L and $d_e$, i.e., neck diameter, length and mouth diameter, of the desired horn resonator have been worked out.

For the three Helmholtz resonators 22, $H_2$ and $H_3$ and the designed horn resonator, the statement is true that the base-frequency $f_G$ of the horn resonator is equal to the resonant frequency $f_{G1}$ of the base-resonator 22 and equal to the average value of the resonant frequencies $f_{G2}$ and $f_{G3}$ of the two Helmholtz resonators $H_2$ and $H_3$ (in connection with this, the limiting walls (in theory) of a conical structure with the dimensions $d_o$, L and $d_e$ are seen in FIG. 4). This resonant frequency relation is in line with the constancy of the dynamic air weight, that is to say of the dynamic weight of the air which is captive in the horn resonator which is a changed form of the base-resonator.

The determination of the congruence condition of an exponential horn with the values $d_o$, $d_e$ and L takes place along the same lines as discussed above. If it appears that the desired congruence cannot be produced with the decreased exponential horn, it is necessary (as in the first case) for the starting values (that is to say L and d of the base-resonator and the horn mouth diameter $d_e$) for the horn resonator to be designed to be changed and for the working out operation to be undertaken again and again with new values till, finally, the congruence of the horn resonator with the decreased exponential horn is worked out for the dimensions $d_o$, L and $d_e$. The wall of the horn resonator, fixed by these three key values is to have a form according to the e-function of the decreased exponential horn. Thus, the transformation is at its best or is optimum. The resonator properties of the horn resonator worked out in this way are not any the worse for this reason, because a lesser widening of the horn resonator right after the horn neck is completely compensated for by the dependently greater widening before the horn mouth (in comparison with the resonator to be seen in thick lines).

In the last design process discussed for working out the horn resonator starting with a Helmholtz resonator, the outcome is even more in line with the needs of general use and there is an even smoother frequency response down to the lowest bass ranges, so that the effects desired are produced with an even better quality.

With the invention, the lower cut-off frequency of a loudspeaker unit may be better radiated than with a normally used loudspeaker unit with the same volume, the efficiency is better for bass radiation and bass reproduction is freer of distortion than with normal loudspeaker units.

To make it possible for the loudspeaker unit to be used for reproduction of a complete audio range, high-pitch (or treble) and medium-pitch systems are used and the treble (or tweeter) loudspeaker or loudspeakers are designed for radiation forward and the medium loudspeaker, placed on the partition 6*b*, is used for radiation on a slope upwards and to the side from the loudspeaker unit. A detailed account will now be given of this structure.

Figure 7:
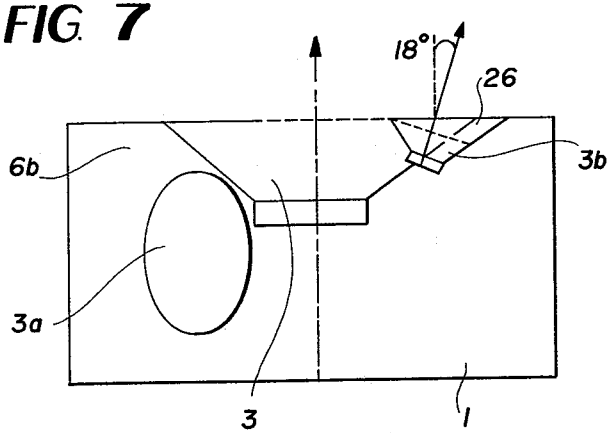
FIG. 7 is a diagrammatic plan view of the loudspeaker box of FIG. 1.

The loudspeaker unit 1, presented in FIG. 6 has, in the bottom part, a forwardly radiating low-pitch (or woofer) loudspeaker 3, which is fixed directly to the support or acoustic wall, as will be seen from FIG. 7. The medium range or tone loudspeaker 3*a* is fixed to the separating wall 6*b* discussed earlier, which is at a slope of 45° with respect to the horizontal, so that the radiation of the medium range loudspeaker 3*a* will be at this angle on a slope upwards. Furthermore, as will be seen from looking at FIGS. 6 and 7, its radiation is sideways and upwards, because the wall 6*b* is turned to the side (see FIG. 7), by 90° with respect to the front support or acoustic wall, on which the low-pitch loudspeaker 3 is fixed. The high-pitch loudspeaker 3*b* is, finally, fixed on its own small support or acoustic wall 26, which is at a slope of 18° with respect to the main support or acoustic wall of the low-pitch or woofer loudspeaker 3, so that the middle axis of the high-pitch loudspeaker makes an angle of 18° with that of the low-pitch loudspeaker 3. If the main radiation direction of the medium-pitch loudspeaker 3*a* is to the left, as clearly shown in the drawings, the main radiation direction of the high-pitch (or tweeter) loudspeaker 3*b* will be to the right, i.e., in the opposite direction.

FIG. 8 is a view of a stereo system with two mirror image loudspeaker units 1 and 1', which are placed at the back wall 110 of a room 111 in which reproduction is to take place. While the two low-pitch loudspeakers 3 and 3' have the property of radiating forward into the room, the radiation of the medium range loudspeaker 3*a* of the left hand unit 1 is upwards on a slope towards the left hand wall and the medium range loudspeaker 3*a'* of the right hand unit 1' is at a slope upwards towards the right hand wall of the room 111, as is made clear by the arrows used for marking the loudspeaker axes. The two further arrows, in each case at a right angle to each other, are for generally marking the limits of the sound or acoustic fields of radiation of the medium range loudspeaker. The two treble or high-pitch loudspeakers 3*b* and 3*b'*, on the other hand, are responsible for radiation which in each case is towards the middle of the room at an angle of 18° in each case with respect to the low-pitch loudspeakers.

Figure 9:
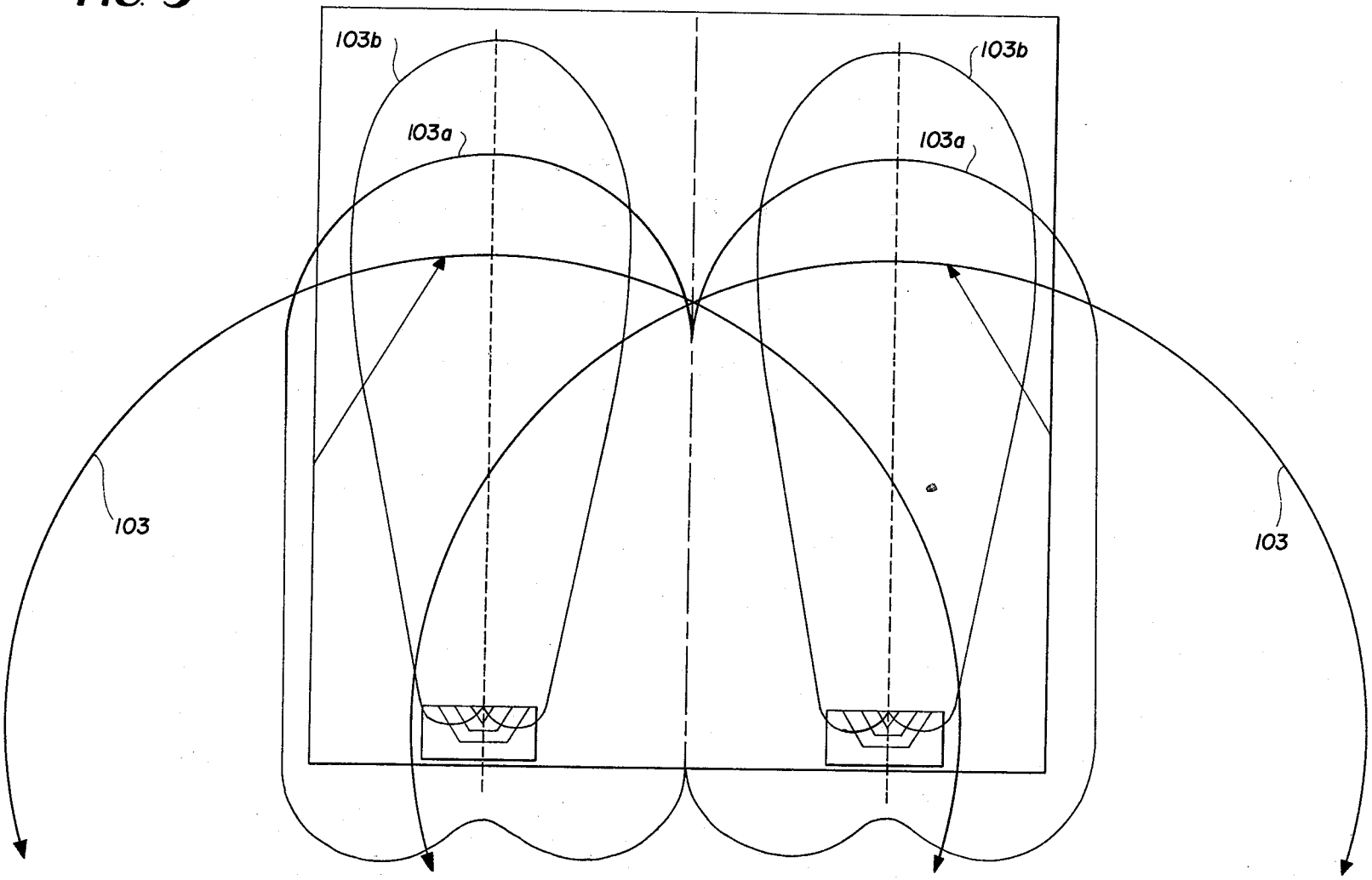
FIG. 9 is a diagram of the acoustic fields radiated by the separate loudspeaker systems of conventional three-way loudspeaker units or boxes.
Figure 10:
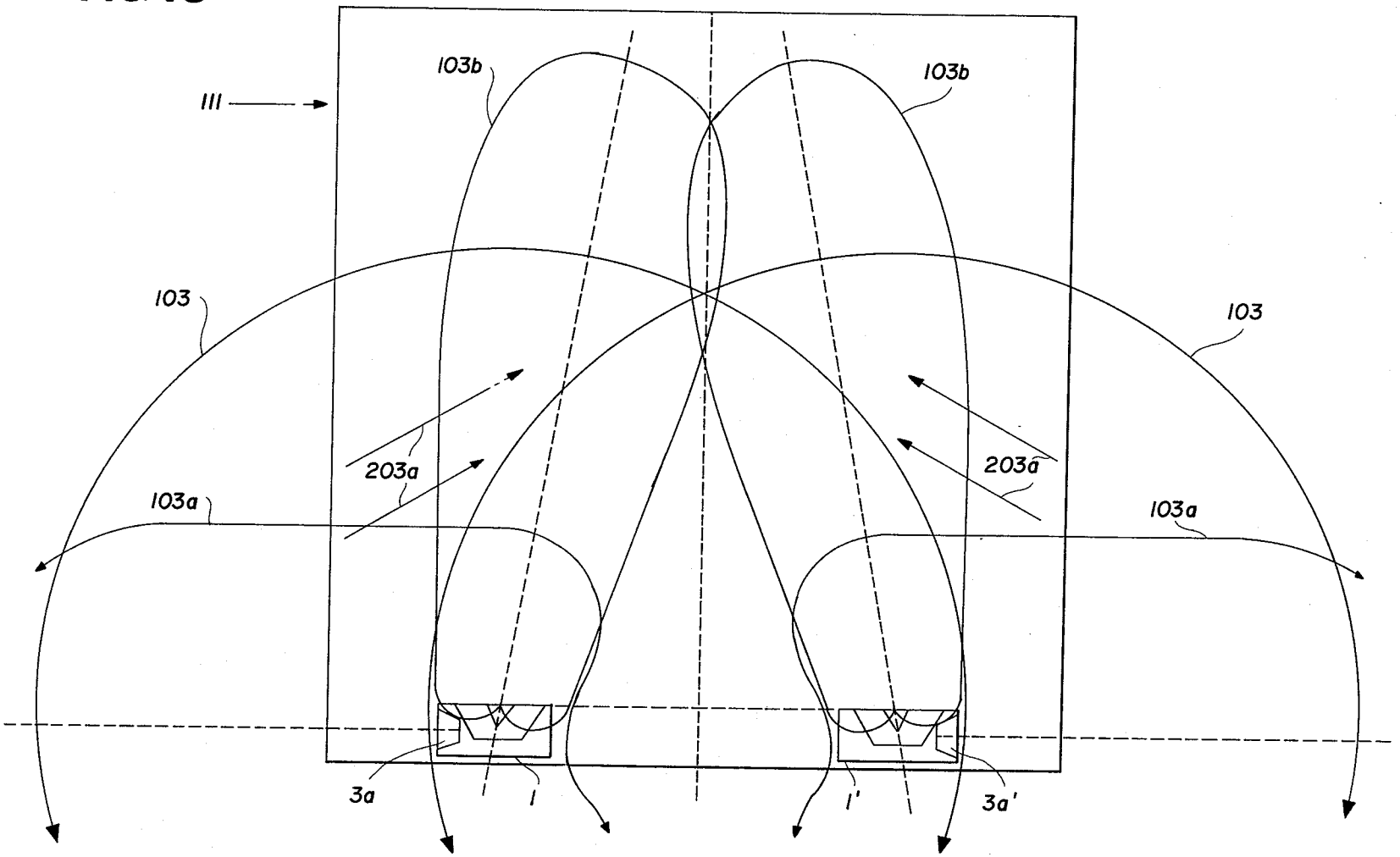
FIG. 10 is a diagram of the acoustic fields radiated by two loudspeaker units incorporating the teaching of the invention.

Using FIGS. 9 and 10, a comparison is now to be made between the radiation behavior of normally used loudspeaker units with those of the invention. FIG. 9 is a view of the acoustic field of normal loudspeaker units. The low-pitch loudspeakers of these units are responsible for the radiation of, generally speaking, spherical acoustic fields 103. This is true as well for the units of the invention seen in FIG. 10. Because the direction of a sound producer with a low frequency may not readily be sensed, in this case as well, no special measures are necessary for acoustic radiation.

The medium range and high range (or treble) loudspeakers are responsible for radiation in the same main direction as the low range (or woofer) loudspeakers. Their acoustic fields 103*a* and 103*b* are, unlike the acoustic fields numbered 103 of the low-pitch loudspeakers, very much narrower. The feeling of breadth of the acoustic producer produced by the medium range loudspeaker is for this reason very much less than in the case of the low-pitch or woofer loudspeaker. Because, however, it is specifically this frequency range which is important for the breadth feeling of the acoustic event, this feeling is, generally speaking, limited to the breadth of the room in which reproduction takes place, so that the feeling of an original room of great size is not able to be given. This is not changed much by the side wall reflections taking place to a small degree and marked in FIG. 9.

Because of the parallel run of the high-pitch lobes 103*b*, the hearer is, generally speaking, at all times outside the main radiation direction of the high-pitch loudspeakers, so that he will not feel their full acoustic power. Furthermore, the acoustic pressure relation between the right hand and the left hand high-pitch loudspeaker will be substantially changed on a sideways motion of the hearer, because he will relatively quickly come out of the main radiation range of one high-pitch or treble loudspeaker and into that of the other, so that the sense of the position of the single acoustic producers of the overall sound picture will be substantially changed with the position of the hearer. The individual musical instruments of an orchestra will seem to be moving in this case along the back wall of the reproduction room.

The acoustic field seen in FIG. 10 and produced with loudspeaker units using the invention on the other hand seems to be different in important respects. The sound radiated by the middle range loudspeakers 3*a* and 3*a'* with a sideways main direction as in the diagrams 103, and, in the frequency range of about 800 Hz to 4 kHz, is reflected by the side walls of the room to a great degree, as has been indicated by the arrows at 203 and, because of this, the desired longer transit time of these acoustic signals is produced. The sound, for this reason, seems to be coming from an outside point very much further away than in the case of FIG. 9, so that the hearer will have the feeling that the three-dimensional breadth of the acoustic event is very much greater. It has turned out that this feeling of greater breadth of the acoustic performances, produced by indirect acoustic paths, does not have any undesired effect on the sound picture produced between the two loudspeaker units, i.e., the broader effect is not in part or completely outweighted by an acoustic hole between the two loudspeaker units (this is related to the change in the characteristics of the harmonics on a change in the number of original acoustic producers).

The two acoustic fields 103*b* pointing towards each other of the treble loudspeakers are responsible for a more even treble sound experience in the reproduction room, because the range, in which the two characteristics 103*b* are cutting into each other, is very much greater than is the case with the treble loudspeakers with radiation straightforward. Furthermore, the relation between the acoustic pressures of the acoustic waves radiated by the two treble loudspeakers or tweeters does not undergo any great change in the cross-direction (that is to say parallel to the line joining the two units), so that the sense of direction which is dependent on the sound-volume differences between the right hand and the left hand loudspeakers, is kept generally at the same level on a motion of the hearer parallel to the loudspeakers.

What is claimed and desired to be secured by Letters Patent of the United States is:

1. A loudspeaker unit having a housing defining a chamber having an acoustic opening and a further opening, a low-range loudspeaker having a diaphragm disposed within said acoustic opening, and a horn structure whose cross-section increases along the length of the horn structure from a neck end to a mouth end thereof, said further chamber opening connecting said chamber with said horn structure neck end, said loudspeaker and said chamber with said further opening forming a system having a base resonant frequency, characterized in that said horn structure is a modified Helmholtz resonator having substantially the same resonant frequency as that of said system, whereby said horn structure functions as a resonator in the same manner as a cylindrical Helmholtz resonator having the same resonant frequency as said system, and said horn structure neck end functions as a low pass filter having substantially the same cut-off frequency as that of said system.

2. A loudspeaker unit as claimed in claim 1 characterized in that the cross-section of said horn structure neck end is equal to the cross-section of said cylindrical Helmholtz resonator, the horn structure being derived from said cylindrical Helmholtz resonator by proportionally increasing the length and cross-section of the cylindrical Helmholtz resonator starting from the end of the cylindrical Helmholtz resonator corresponding to the horn structure neck end, while maintaining dynamic air weight substantially the same as that of said cylindrical Helmholtz resonator, to produce a horn structure mouth end having a cross-section at least as large as the cross-section of said loudspeaker diaphragm.

3. A loudspeaker unit as claimed in claim 1 characterized in that the neck end cross-section of the horn structure is equal to the cross-section of a second cylindrical Helmholtz resonator $H_2$ whose length is equal to the length of said first cylindrical Helmholtz resonator and whose resonant frequency is below the resonant frequency of said first cylindrical Helmholtz resonator, in an amount as the resonant frequency of said first cylindrical Helmholtz resonator is below that of a third cylindrical Helmholtz resonator $H_3$, having the same length as that of said first and second Helmholtz resonators, and having a cross-section which is equal to the mouth end cross-section of said horn structure.

4. A loudspeaker unit as claimed in claim 1 where said housing includes a separating wall which defines, with said housing, said chamber and said horn structure.

5. A loudspeaker unit as claimed in claim 4, characterized in that said horn structure extends outside the housing from a back radiation field of said loudspeaker.

6. A loudspeaker unit as claimed in claim 1 characterized in that the loudspeaker is disposed on a lower portion of a front vertical wall of the housing to radiate forwardly.

7. A loudspeaker unit as claimed in claim 4 characterized in that said chamber has a depth, width and length whose relative dimensions are respectively one to the square root of two to two.

8. A loudspeaker unit as claimed in claim 1 characterized in that a medium-range loudspeaker is disposed in said housing at a slope to a horizontal plane for radiation to one side of the housing and upward of the housing and at least one high-range loudspeaker is disposed in said housing at a slope to a vertical plane for radiation to an opposite side of the housing.

9. A loudspeaker unit as claimed in claim 8 characterized in that the medium-range loudspeaker has a middle axis extending orthogonally of a middle axis of the low-range loudspeaker and extending at an angle to the horizontal plane in the range of 35° to 55°.

10. A loudspeaker unit as claimed in claim 8 characterized in that the high-range loudspeaker has a horizontally extending middle axis disposed at an angle of approximately 18° to a horizontally extending middle axis of the low-range loudspeaker.

11. A loudspeaker unit as claimed in claim 10, wherein said loudspeaker unit includes a vertical wall support structure for said high-pitch loudspeaker, disposed at an angle of 18° to the front of said housing.

12. A loudspeaker unit as claimed in claim 8, including a second loudspeaker unit which is a mirror image of the first unit and having medium range loudspeakers radiating towards the side walls of the reproduction room to form a stereo system.

13. A loudspeaker unit having a housing defining a chamber having an acoustic opening and a further opening, a low-range loudspeaker having a diaphragm and being disposed within said acoustic opening, and a horn structure whose cross-section increases along the length of the horn structure from a neck end to a mouth end thereof, said further chamber opening connecting said chamber with said horn structure neck end, said loudspeaker and said chamber with said further opening forming a system having a base resonant frequency, characterized in that:

said horn structure is a modified Helmholtz resonator having substantially the same resonant frequency as that of said system formed by said loudspeaker and said chamber with said further opening;

said horn structure has a neck cross-section, a mouth cross-section, and a length which are respectively equal to a neck cross-section, mouth cross-section, and length of an exponential horn which is proportionally reduced in size from an original exponential horn having a neck cross-section equal to that of the loudspeaker diaphragm; and the mouth cross-section of said horn structure is at least as large as the cross-section of said loudspeaker diaphragm;

whereby said further chamber opening forms with the adjoined horn structure an acoustical low pass filter having a cut-off frequency equal to the resonant frequency of said system, and said horn structure also functions as a resonator having a resonant frequency substantially equal to that of said system, in the same manner as a cylindrical Helmholtz resonator having the same resonant frequency as said system.

14. A loudspeaker unit as described in claim 13, wherein said horn structure is congruent with said exponential horn.

* * * * *

UNITED STATES PATENT AND TRADEMARK OFFICE

CERTIFICATE OF CORRECTION

PATENT NO. : 4,251,687

DATED : February 17, 1981

INVENTOR(S) : Hans Deutsch

It is certified that error appears in the above—identified patent and that said Letters Patent is hereby corrected as shown below:

Under ABSTRACT, line 20, cancel "are increased".

Column 1, line 66, cancel "orchestra" and insert --loudspeaker--.

Column 2, line 47, cancel "base" and insert --bass--.

Column 3, line 53, cancel "so that".

Column 4, line 20, after "stereo-pair" insert --are--;

line 32, after the first "," insert --and is --;

line 46, cancel "Because there is";

line 47, cancel "a question concerning up to about 4 kHz" and insert --Up to about 4 kHz,--, and cancel "of the same";

line 48, cancel entire line;

line 49, cancel entire line;

line 50, cancel "with a broader radiation base,"; and line 51, cancel "in this respect as well".

Column 6, line 43, cancel "decrease in size" and insert --decrease-in-size--;

UNITED STATES PATENT AND TRADEMARK OFFICE

CERTIFICATE OF CORRECTION

PATENT NO. : 4,251,687

DATED : February 17, 1981

INVENTOR(S) : Hans Deutsch

It is certified that error appears in the above—identified patent and that said Letters Patent is hereby corrected as shown below:

line 68, cancel "and its dynamic air weight".

Column 10, line 23, cancel "is numbered 15"; and line 41, cancel "the answer" and insert --a--.

Column 14, line 41, cancel "resonator" and insert --resonators--.

Column 16, line 64, cancel "203" and insert "203a".

Signed and Sealed this

*Third* Day of *November 1981*

[SEAL]

*Attest:*

GERALD J. MOSSINGHOFF

*Attesting Officer*

*Commissioner of Patents and Trademarks*